US007387151B1

(12) United States Patent
Payne

(10) Patent No.: US 7,387,151 B1
(45) Date of Patent: Jun. 17, 2008

(54) CABINET DOOR WITH CHANGEABLE DECORATIVE PANEL

(76) Inventor: Donald L. Payne, 1145 Cochran La., Lewisburg, TN (US) 37091

( * ) Notice: Subject to any disclaimer, the term of this patent is extended or adjusted under 35 U.S.C. 154(b) by 374 days.

(21) Appl. No.: 10/763,879

(22) Filed: Jan. 23, 2004

(51) Int. Cl.
*A47G 5/00* (2006.01)

(52) U.S. Cl. ..... 160/371; 49/501; 312/204

(58) Field of Classification Search ..... 312/204; 52/222; 160/371, 369, 377, 378, 368.1; 49/501; 40/603, 604, 791; 38/102.21, 109.91
See application file for complete search history.

(56) References Cited

U.S. PATENT DOCUMENTS

| | | | | |
|---|---|---|---|---|
| 1,964,332 | A * | 6/1934 | Rembaum | 160/369 |
| 2,233,412 | A * | 3/1941 | Hill | 160/378 |
| 2,377,449 | A * | 6/1945 | Prevette | 160/369 |
| 2,508,506 | A * | 5/1950 | Fridolph | 160/378 |
| 2,533,565 | A | 12/1950 | Eichelmon | |
| 3,408,127 | A | 10/1968 | Vincens | |
| 3,696,885 | A * | 10/1972 | Grieg et al. | 181/141 |
| 3,697,363 | A | 10/1972 | Martinez | |
| 3,826,551 | A | 7/1974 | Schwartz | |
| 3,982,345 | A * | 9/1976 | Coleman | 160/378 |
| 4,103,375 | A * | 8/1978 | Santo | 312/204 |
| 4,127,156 | A * | 11/1978 | Brandt | 160/371 |
| 4,158,277 | A | 6/1979 | Krempp et al. | |
| 4,502,260 | A * | 3/1985 | Machler | 160/369 |
| 4,800,947 | A | 1/1989 | Loomis | |
| 5,368,378 | A | 11/1994 | Curtis | |
| 5,507,109 | A * | 4/1996 | Rinzler | 40/603 |
| 5,717,171 | A * | 2/1998 | Miller et al. | 181/150 |
| 5,791,752 | A | 8/1998 | Hartman | |
| 6,053,585 | A | 4/2000 | Osen | |
| 6,142,254 | A * | 11/2000 | Claybaugh et al. | 181/141 |
| 6,182,307 | B1 | 2/2001 | Rutrick | |
| 6,530,165 | B2 * | 3/2003 | Griesemer et al. | 160/378 |
| 6,658,677 | B2 * | 12/2003 | Paul | 5/280 |
| 6,996,929 | B1 * | 2/2006 | Greene et al. | 40/617 |
| 2002/0011015 | A1 * | 1/2002 | Larson et al. | 40/603 |
| 2003/0061654 | A1 * | 4/2003 | Lenner | 5/2.1 |
| 2004/0107655 | A1 * | 6/2004 | Hudoba | 52/222 |
| 2005/0079311 | A1 * | 4/2005 | Keller | 428/50 |
| 2006/0169426 | A1 * | 8/2006 | McGregor et al. | 160/371 |

FOREIGN PATENT DOCUMENTS

| | | |
|---|---|---|
| FR | 2485118 | * 12/1981 |
| FR | 2618481 | * 1/1989 |

* cited by examiner

*Primary Examiner*—Lanna Mai
*Assistant Examiner*—Hanh V. Tran
(74) *Attorney, Agent, or Firm*—Steven Mark Clodfelter

(57) ABSTRACT

A cabinet door assembly having a wooden cabinet door with a peripheral frame and an open center is provided with features enabling a fabric panel to be mounted on the door in a manner such that panels may be readily removed and replaced with other panels. An upper member of the frame has a slot which receives a dowel pin carried in an upper loop of the panel fabric, and a lower frame member has a slot which receives the lower end of the panel and directs a lower dowel pin carried at the lower end into a capturing position. The panel is pulled tightly by tension applied to the dowel pins. Side frame members each have on an inner side a narrow slot receiving edges of the panel. The panel is secured in place by the lower dowel pin, which is being restrained by projections at end locations past side edges of the panel.

10 Claims, 2 Drawing Sheets

CABINET DOOR WITH CHANGEABLE DECORATIVE PANEL

FIELD OF THE INVENTION

This invention relates to decorative panels for placement on cabinet doors and more particularly to removable fabric panels which may be installed on wooden cabinet doors.

BACKGROUND OF THE INVENTION

One of the most common structures for cabinet doors, and particularly doors for kitchen cabinets, comprises an outer rectangular frame and a central panel supported by and connected to the frame. The central frame lends itself to use as a location for placement of a decorative display, which may be a component of an overall decorative scheme. A desired feature for a decorative center panel location would be a capability of the panel for being easily installed, removed and replaced without damaging or marring the structure. This would enable use of selected decorative materials for special occasions or with changes of the seasons.

Modifications of center panel structure to obtain decorative variety have been made previously, with rigid, slideably installed panels being substituted for or used in addition to existing panels. It is desired to provide replacement panels in the form of flexible fabric which may be readily installed and removed without use of any tools.

SUMMARY OF THE INVENTION

The present invention is directed to a cabinet door assembly including a frame made up of an upper member, a lower member and left and right side members surrounding an open center space, a fabric panel covering the open space and removably connected to the frame, and upper and lower tensioning dowel pins placed in upper and lower loops of the fabric panel. The upper frame member has a slot which extends through this member and is accessible to receiving the fabric and upper dowel pin from above. This slot is narrowed along its lower side in order to secure the upper dowel pin in place when installed. The lower frame member is made accessible to receiving the lower fabric loop and lower dowel pin from the side. In order to allow the panel to follow a straight path in the lower member when installed, the upper half on the back side of this member has a one-half portion of its thickness removed, except at each end where projecting corners are retained to secure the lower dowel pen in place when installed. Each of the ends of the lower dowel pin is positioned to be pulled tight underneath a protruding corner when tension force is applied against the fabric panel. Each of the side members is provided with a narrow slot along its inner side to receive an outer edge area of the panel and secure it in place.

The fabric panel, when installed as indicated, provides a neat and orderly appearance, and very little of its structural and support features are visible. The top connection is completely out of sight, and the bottom one is can be seen only when the cabinet door is open.

DESCRIPTION OF THE PREFERRED EMBODIMENT

Figure 1:
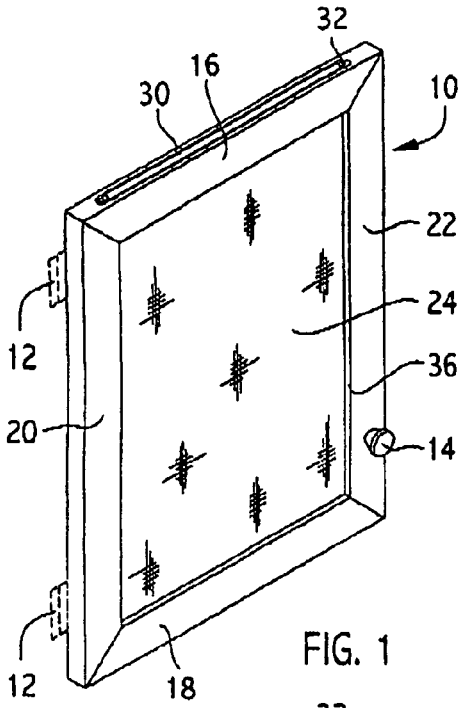
FIG. 1 is a perspective view of a cabinet door assembly embodying the invention, taken from the front side.
Figure 2:
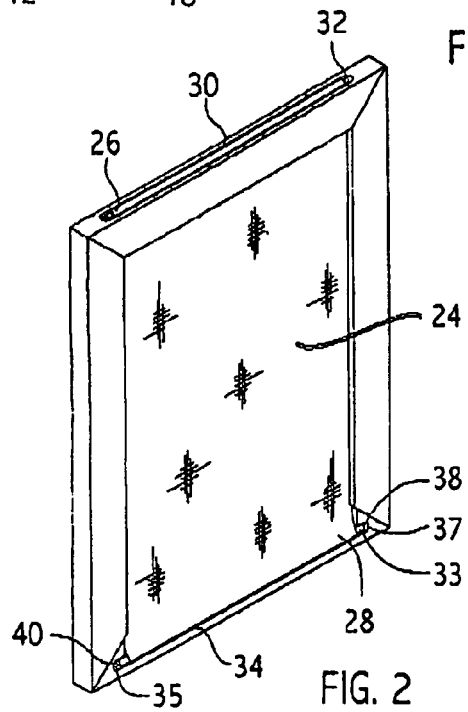
FIG. 2 is a perspective view of the assembly, taken from the rear side.
Figure 3:
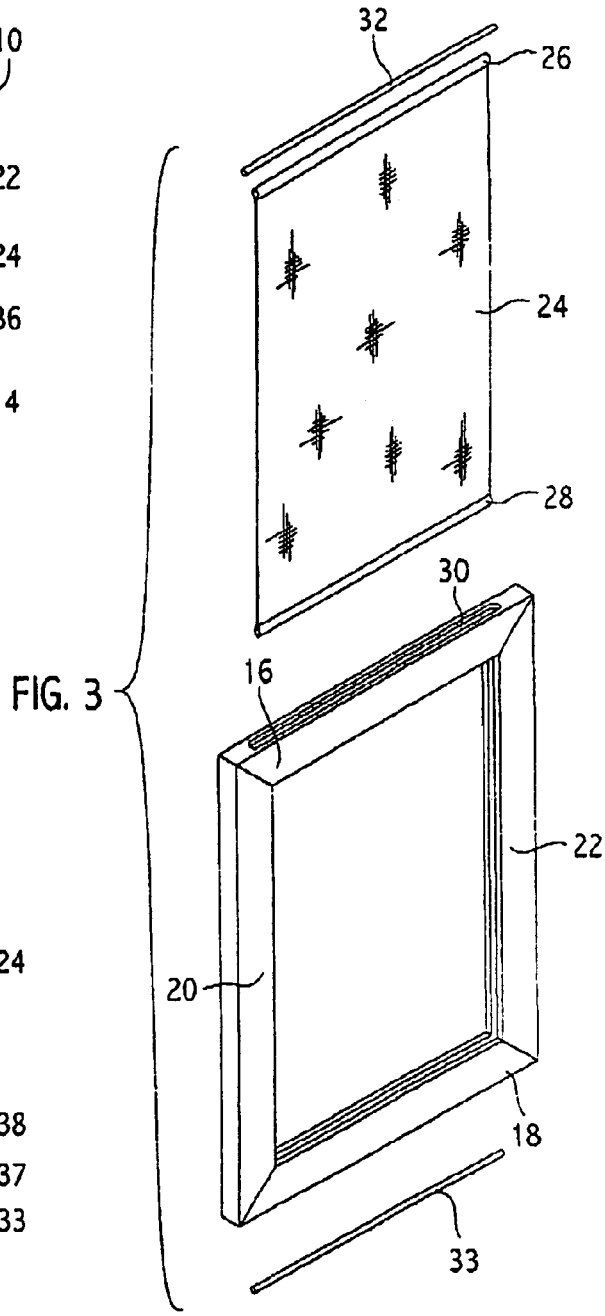
FIG. 3 is an exploded view of the assembly, taken from the front.
Figure 4:
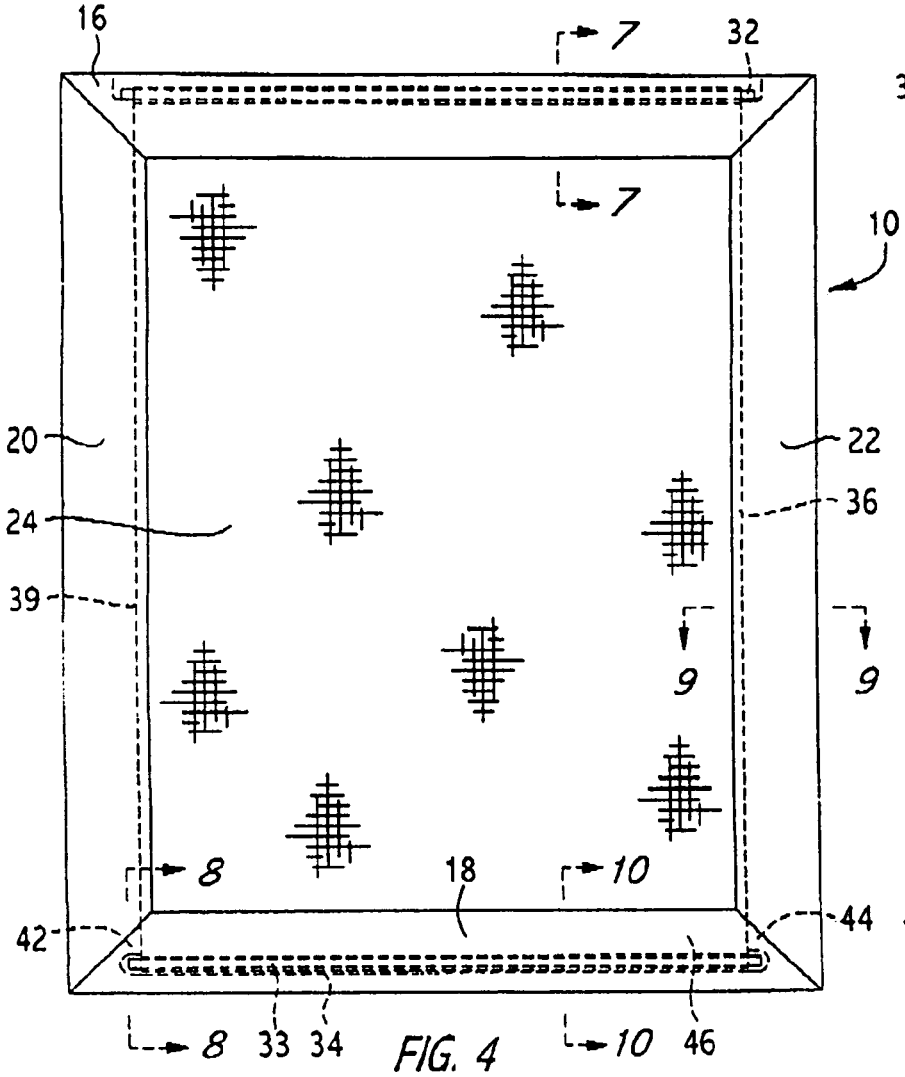
FIG. 4 is a front elevational view of the door, with internal features shown in dashed lines.

Referring to FIG. 1 of the drawings, there is shown a cabinet door 10 with a fabric panel according to the invention. The door is provided with a pair of hinges 12 for mounting on cabinet framework (not shown) and a knob 14 to facilitate opening. The door has an upper frame member 16, a lower member 18, a left side member 20 and a right side member 22. As shown in FIG. 3, fabric panel 24 has an upper loop 26 across the top and a lower loop 28 across the bottom of the panel. These loops, which may be formed by stitching, are adapted to receive an upper dowel pin 32 and a lower dowel pin 33, The dowel pins enable the panel to be stretched tight by tension when installed as directed. Side members 20 and 22 each have a slot 36, 39 (FIG. 4) extending along the length of the member at its inside edge, the slots serving to hold side edge portions of the panels in place when installed. Upper member 16 has an elongated slot 30 along its length at the upper edge for receiving upper dowel pin 32.

Figure 8:
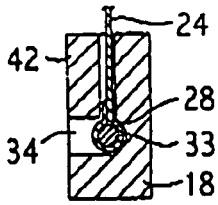
FIG. 8 is a sectional view taken across a portion of lower member 18 along line 8-8.

As shown in FIGS. 2, 4, 6, 8 and 10, bottom member 18 is provided with features enabling bottom dowel pin 33 to be placed in side slot 34 at each end area of this dowel pin (FIG. 8). The middle portion of 46 of member 18, corresponding in length with the width of panel 24, has the upper half of its thickness 46 removed (FIG. 10) to enable the lower end of the panel to be held in the same plane as the rest of the panel when installed. At ends of the lower dowel pin 33, and past side edges of the panel, none of the thickness of member 18 is removed, leaving projecting corner areas 42, 44 under which each end of the dowel pin may be secured.

Figure 5:
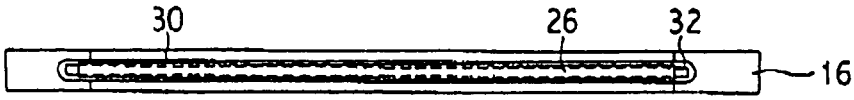
FIG. 5 is a top view of the door showing the upper dowel pin and slot.
Figure 7:
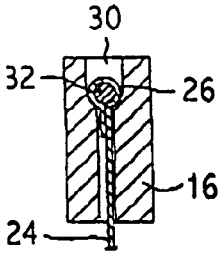
FIG. 7 is a sectional view taken along line 7-7 Of FIG. 4.

FIG. 5 and FIG. 7 show top slot 30 in upper frame member 16 in which upper dowel pin 32 carried in upper loop 26 of the panel 24 is located. The slot is narrowed below the dowel pin so that only the panel fabric 24 passes all the way through the slot, while the dowel pin is restrained.

Figure 6:
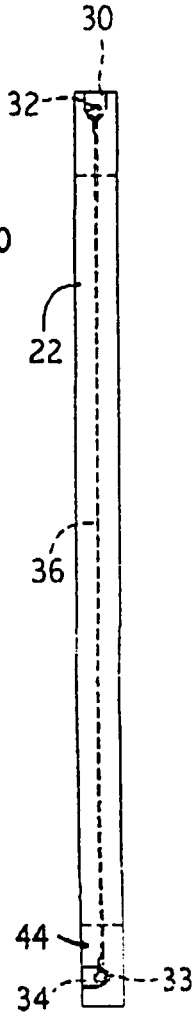
FIG. 6 is a side view with a slot shown in dashed lines.

FIG. 6 shows the top dowel pin 32 inserted from the top and secured in top slot 30, while bottom dowel pin 33 is inserted from the side in slot 34 which extends perpendicular to the plane of the panel.

Figure 9:
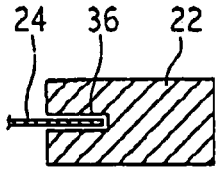
FIG. 9 is a sectional view taken across line 9-9 of FIG. 4.

FIG. 9 shows a slot 36 on the inside of side member 22, this slot receiving an edge area of the panel fabric and keeping the edge of the fabric in straight alignment.

Figure 10:
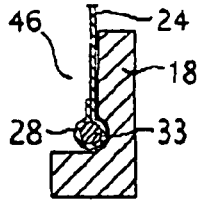
FIG. 10 is a sectional view taken across line 10-10 of FIG. 4.

FIG. 10 indicates that the portion of the outside of lower member 18 is removed, except for end areas, leaving a void space 46 and allowing the fabric panel between end areas to be aligned in the same plane as upper portions of the panel.

In modifying a conventional cabinet door to include the features required for the present invention a preferred approach is to use a router to cut the necessary slots and to remove the necessary thickness of wood in the lower frame member as described. Such features could also be incorporated into newly manufactured doors.

While the invention is described with reference to a specific embodiment, it is not to be understood as being limited to this embodiment, but is limited only as provided by the appended claims. For example, the fabric panel pay be installed by pulling it upward over the open space, with the necessary slots being placed in reversed positions. Also the panel could be installed by being pulled horizontally instead of vertically, which would require different placement of the necessary slots.

The invention claimed is:

1. A door assembly comprising:

a cabinet door frame including a solid upper frame member, a solid lower frame member, a pair of solid opposing side members, said opposing side members attached to said upper frame member and said lower frame member, and an open space defined between said upper frame member, said lower frame member and said pair of opposing side members, and one of said upper frame member and said lower frame member having a narrow slot slightly wider than a sheet of fabric extending between an inner edge and an outer edge of said one of said upper frame member and said lower frame member, said narrow slot extending in said one of said upper frame member and said lower frame member at least a width of said open space, with a groove along said outer edge communicating in parallel relation with said slot, and the other of said upper frame member and said lower frame member having a recess extending at least a width of said open space and along an inner side thereof, and opposed notches at lower outer regions of said recess, said slot, said groove and an inner surface of said recess being coplanar within planes defined by inner sides and outer sides of said cabinet door frame, a decorative fabric sheet panel having a first tubular loop contiguous with and formed at one end of said fabric sheet panel and a second tubular loop contiguous with and formed at the other end of said fabric sheet panel, said fabric sheet panel extending through said slot so that said one of said first tubular loop and said second tubular loop resides in said groove in said outer edge of said one of said upper frame member and said lower frame member, a first dowel pin inserted through said one of said first tubular loop and said second tubular loop and positioned in said groove, thereby securing said fabric sheet panel in place in said one of said upper frame member and said lower frame member, a second dowel pin inserted through the other of said first tubular loop and said second tubular loop, with ends of said second dowel pin engaging said opposed notches of said recess, thereby securing and tensioning said fabric sheet panel in said open space in said cabinet door coplanar with said recess, said slot and said groove, said fabric sheet panel secured within said planes defined by said inner sides and said outer sides of said cabinet door frame.

2. The cabinet door assembly of claim 1, wherein said opposing side members each have a narrow slot in an inner edge.

3. The cabinet door assembly of claim 2, wherein said fabric sheet panel further extends unsupported along each side into each said narrow slot of each of said opposed side members.

4. The cabinet door assembly of claim 1, wherein said first tubular loop and said second tubular loop extend an entire width of said fabric sheet panel.

5. The cabinet door assembly of claim 3, wherein said recess is generally of a width of said fabric sheet panel.

6. The cabinet door assembly of claim 1, wherein said flexible sheet panel is supported and stretched between said outer edge of said one of said upper frame member and said lower frame member and an opposed said one of said upper frame member and said lower frame member.

7. The cabinet door assembly of claim 1 wherein said solid upper frame member, said solid lower frame member and said pair of solid opposing side members are made of wood.

8. A decorative cabinet door assembly comprising:

a generally rectangular frame including an upper frame member, a lower frame member, a pair of opposing side members and an open space defined between said upper frame member, said lower frame member and said pair of opposing side members, said opposing side members each having a narrow slot in an inner edge thereof and one of said upper and lower frame members having a slot extending between an inner edge and an outer edge of said frame, said slot extending at least a width of said open space, with a groove along said outer edge and communicating in parallel relation with said slot, and the other of said upper frame member and said lower frame member having a recess along an inner side thereof, and opposed notches at lower outer regions of said recess, said slot, each said narrow slot and an inner surface of said recess all being coplanar within confines of planes defined by inner sides and outer sides of said frame;

a decorative changeable, flexible, fabric sheet panel slightly wider than said open space and having a first tubular loop contiguous with and formed at one end of said fabric sheet panel and a second tubular loop contiguous with and formed at the other end of said fabric sheet panel, said first tubular loop and said second tubular loop extending an entire width of said fabric sheet panel, one of said first tubular loop and said second tubular loop removably extending straight through said slot and residing in said groove in said one of said upper frame member and said lower frame member, said flexible sheet panel also extending straight into said recess, said recess being generally of a width of said fabric sheet panel, said fabric sheet panel extending into each said narrow slot of each of said opposed side members, a first dowel pin inserted through the loop that extends through said slot, said first dowel pin positioned in said groove, thereby securing said fabric sheet panel in place in said one of said upper frame member and said lower frame member, a second dowel pin inserted through the other of said first loop and said second loop, with ends of said second dowel pin engaging said opposed notches of said recess, thereby securing said fabric sheet panel in said recess and tensioning said fabric sheet panel between said upper frame member and said lower frame member, wherein said flexible sheet panel is supported and stretched between said outer edge of said one of said upper frame member and said lower frame member and said second dowel pin engaging said opposed notches, and within said confines of said planes defined by said inner sides and said outer sides of said frame.

9. The decorative cabinet door assembly as set forth in claim 8 wherein said generally rectangular frame is made of wood.

10. A generally rectangular frame including an upper frame member, a lower frame member, a pair of opposing side members and an open space defined between said upper frame member, said lower frame member and said pair of opposing side members, said opposing side members each having a narrow slot in an inner edge thereof and one of said upper and lower frame members having a slot extending between an inner edge and an outer edge thereof, with a groove along said outer edge communicating in parallel relation with said slot, and the other of said upper frame member and said lower frame member having a recess along an inner side thereof, and opposed notches at lower outer regions of said recess, said slot, each said narrow slot and an inner surface of said recess all being coplanar;

a decorative changeable, flexible, fabric sheet panel slightly wider than said open space and having a first tubular loop contiguous with and formed at one end of said fabric sheet panel and a second tubular loop contiguous with and formed at the other end of said fabric sheet panel, said first tubular loop and said second tubular loop extending an entire width of said fabric sheet panel, one of said first tubular loop and said second tubular loop removably extending straight through said slot and resides in said groove in said one of said upper frame member and said lower frame member, said flexible sheet panel also extending straight into said recess, said recess being generally of a width of said fabric sheet panel, said fabric sheet panel further extending unsupported along each side into each said narrow slot of each of said opposed side members, a first dowel pin inserted through the loop that extends through said slot, said first dowel pin positioned in said groove, thereby securing said fabric sheet panel in place in said one of said upper frame member and said lower frame member, a second dowel pin slightly longer than the other of said first loop and said second loop and inserted through the other of said first loop and said second loop, with ends of said second dowel pin engaging said opposed notches of said recess, thereby securing said fabric sheet panel in said recess and tensioning said fabric sheet panel between said upper frame member and said lower frame member, wherein said flexible sheet panel is supported and stretched between said outer edge of said one of said upper frame member and said lower frame member and an opposed said one of said upper frame member and said lower frame member.

* * * * *